US009763516B1

(12) United States Patent
Pan

(10) Patent No.: US 9,763,516 B1
(45) Date of Patent: Sep. 19, 2017

(54) STORAGE RACK OF TABLE

(71) Applicant: Oasyschair Co., Ltd., Tainan (TW)

(72) Inventor: Toung-Chun Pan, Tainan (TW)

(73) Assignee: Oasyschair Co., Ltd., Tainan (TW)

( * ) Notice: Subject to any disclaimer, the term of this patent is extended or adjusted under 35 U.S.C. 154(b) by 0 days.

(21) Appl. No.: 15/162,666

(22) Filed: May 24, 2016

(51) Int. Cl.
*A47B 81/00* (2006.01)
*A47B 43/00* (2006.01)
*A47B 3/00* (2006.01)

(52) U.S. Cl.
CPC ..... *A47B 81/00* (2013.01); *A47B 3/002* (2013.01); *A47B 43/00* (2013.01); *A47B 2200/0084* (2013.01)

(58) Field of Classification Search
CPC ... A47B 17/03; A47B 2019/006; A47B 81/00; A47B 19/08; A47B 21/007; A47B 21/0314; A47B 3/002; A47B 43/00; A47B 2021/0321; A47B 2021/0335; A47B 2021/0328; A47B 83/04; A47B 46/005; A47B 46/00; A47B 2003/008; A47B 2003/025; A47B 2003/145; A47B 2200/0084
See application file for complete search history.

(56) References Cited

U.S. PATENT DOCUMENTS 2,113,689 A * 4/1938 Haban ..... A47B 3/02 108/119
3,428,382 A * 2/1969 Yarnell ..... A47B 21/0314 312/208.1
3,857,623 A * 12/1974 Schneller ..... A47B 46/005 312/266
4,691,888 A * 9/1987 Cotterill ..... A47B 21/02 108/1
5,176,351 A * 1/1993 Moore ..... A47B 21/0314 108/138
5,302,015 A * 4/1994 Du Vall ..... A47B 21/0314 248/286.1
5,490,466 A * 2/1996 Diffrient ..... A47B 21/0314 108/138
5,556,179 A * 9/1996 Weidner ..... A47B 63/00 312/190
5,588,375 A * 12/1996 Cotterill ..... A47B 21/0314 108/102
6,435,634 B1 * 8/2002 Webb ..... A47B 96/025 248/447
6,997,531 B2 * 2/2006 Kim ..... F25D 25/02 108/136
7,316,326 B2 * 1/2008 Kim ..... F25D 25/027 211/150
7,618,103 B2 * 11/2009 Kim ..... A47B 46/00 108/138
2012/0037051 A1 * 2/2012 Wang ..... A47B 3/12 108/106
2012/0217858 A1 * 8/2012 Lai ..... A47B 17/00 312/334.5

* cited by examiner

*Primary Examiner* — Patrick Hawn
(74) *Attorney, Agent, or Firm* — Alan D. Kamrath; Kamrath IP Lawfirm, P.A.

(57) ABSTRACT

A storage rack for use as a storage element on the underside of a folding table is fixed to a predetermined portion of the underside of the table and has a foldable configuration. The storage rack can be folded along with the table and can be unfolded into a horizontal state along with the table in order for the table to store an object on the storage rack.

14 Claims, 8 Drawing Sheets

STORAGE RACK OF TABLE

BACKGROUND OF THE INVENTION

1. Technical Field

The present invention relates to a storage rack of a table. More particularly, the present invention relates to a foldable storage rack connected to the underside of a folding table. When the table is unfolded, the storage rack is also unfolded and assumes a horizontal position in order to store an object thereon, and when the table is not in use and gets folded, the storage rack is folded along with the table.

2. Description of Related Art

A table designed to support objects placed thereon generally has a fixed configuration for enhanced stability, and the underside of the table may be additionally connected with a storage rack of a predetermined configuration to facilitate storage of objects. The storage rack, if provided, is connected to a predetermined portion of the table and, to be in line with the attributes of the table, also has a fixed configuration. While such a table is indeed useful, it is disadvantaged by its not being foldable, i.e., being unable to reduce the space taken up by itself, when not in use. Those who are subject to limitations in interior space, therefore, would choose a folding table instead. Due to their overall structure, however, the conventional folding tables do not allow a storage element to be incorporated into their tabletop or foldable legs. To store an object which is temporarily not in use, the user of a folding table can only put the object at a corner of the tabletop or on a nearby table or chair. In this regard, the conventional folding tables leave something to be desired.

In light of the above and to overcome the aforesaid drawback of the conventional folding tables, a storage element, or more particularly a foldable storage rack is configured to be connected to the underside of a folding table, to be unfolded and assume a horizontal, object-storing position when the table is unfolded, and to be folded along with the table when the table is not in use.

BRIEF SUMMARY OF THE INVENTION

The present invention provides a storage element to be connected to the underside of a conventional folding table as an improvement of the table. More specifically, a foldable storage rack is provided to be connected to a predetermined portion of the underside of a folding table. The storage rack can be folded along with the table and unfolded into a horizontal position when the table is unfolded so that the table can store an object on the storage rack.

The primary objective of the present invention is to provide a storage rack for use as a storage element on the underside of a folding table. The storage rack is connected to the underside of the table and includes at least two fixing bases, a plurality of suspension members, at least two connecting members, and a plurality of supporting members. Each of the fixing bases has a downwardly recessed portion and is configured to receive and pivotally connect with, on either side of the downwardly recessed portion, an upper end of one of the suspension members, while the opposite lower end of the suspension member is pressed against and pivotally connected with a predetermined lateral portion of the corresponding connecting member. The two connecting members have corresponding sides each protrudingly provided with a plurality of projections, which may be arranged at a predetermined spacing. Each of the supporting members has two ends each inserted and retained by the corresponding projection of the corresponding connecting member. The storage rack is fixed to a predetermined portion of the underside of the table, can be folded along with the table, and can be unfolded into a horizontal state along with the table in order for the table to store an object on the storage rack.

The second objective of the present invention is to provide the forgoing storage rack. Each of the fixing bases has a predetermined section concavely provided with said downwardly recessed portion. The downwardly recessed portions are configured to receive a fixing member provided on a predetermined portion of the underside of the table, and each of the fixing bases is fixed to the fixing member via a threaded fastener.

The third objective of the present invention is to provide the foregoing storage rack. Each of the suspension members is pivotally connected to the adjacent, or corresponding, fixing base via a pin. Each of the pins passes through a hole in the corresponding suspension member and a hole in a corresponding portion of the corresponding fixing base and has one end protruding from an opposite side of the corresponding fixing base and fastened with a position-limiting element. Thus, each of the suspension members is pivotally connected to one end of the corresponding fixing base.

The fourth objective of the present invention is to provide the foregoing storage rack. Each of the suspension members is pivotally connected to the adjacent, or corresponding, connecting member via a threaded fastener. Each of the threaded fasteners passes through a sleeve fitted into a hole in the corresponding suspension member and has one end threadedly engaged with a threaded hole in the corresponding connecting member. Thus, each of the suspension members is pivotally connected to the corresponding connecting member.

The fifth objective of the present invention is to provide the foregoing storage rack. Each of the projections of the corresponding sides of the two connecting members is peripherally provided with a plurality of raised and recessed areas to facilitate insertion into one said end of the corresponding supporting member and to ensure that the two ends of each of the supporting members are securely connected to the connecting members.

The sixth objective of the present invention is to provide the foregoing storage rack. Each end of the supporting member connected between the middle sections of the two connecting members is penetrated by a positioning pin inserted into the corresponding projection of the corresponding connecting member to ensure that the supporting member is securely connected between the two connecting members.

BRIEF DESCRIPTION OF THE SEVERAL VIEWS OF THE DRAWINGS

FIG. 1-1 is an enlarged view of certain components in FIG. 1;

DETAILED DESCRIPTION OF THE INVENTION

Figure 1:
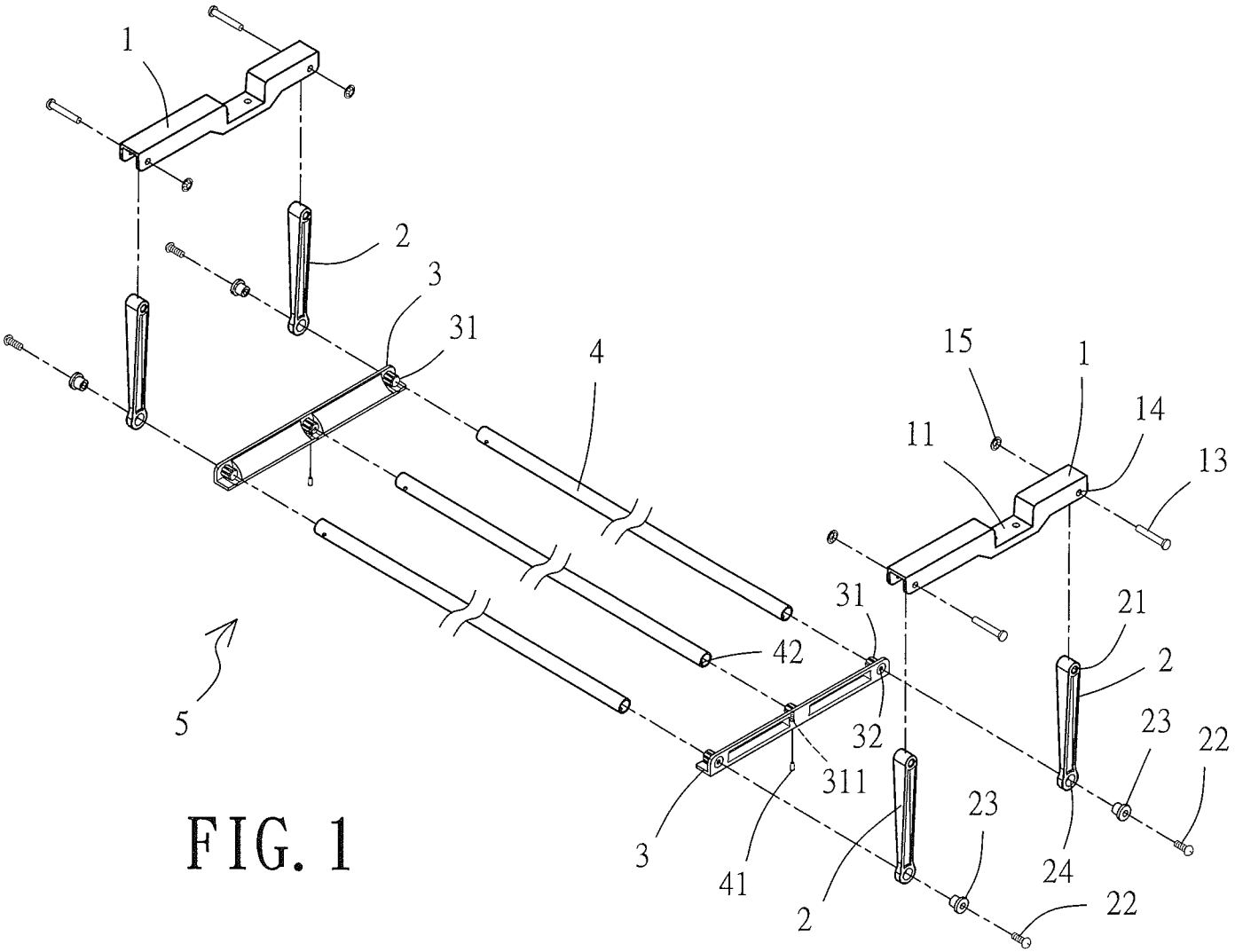
FIG. 1 is an exploded perspective view of a storage rack according to the present invention.
Figure 1:
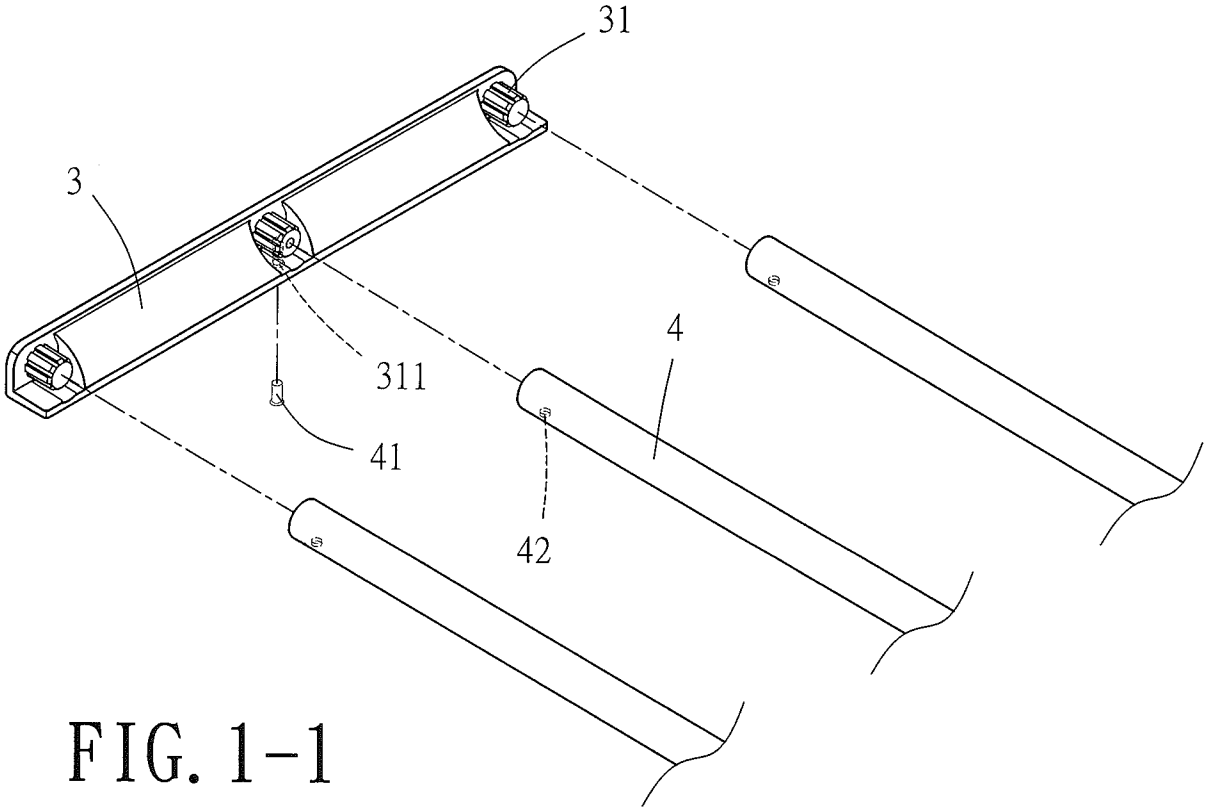
Figure 4:
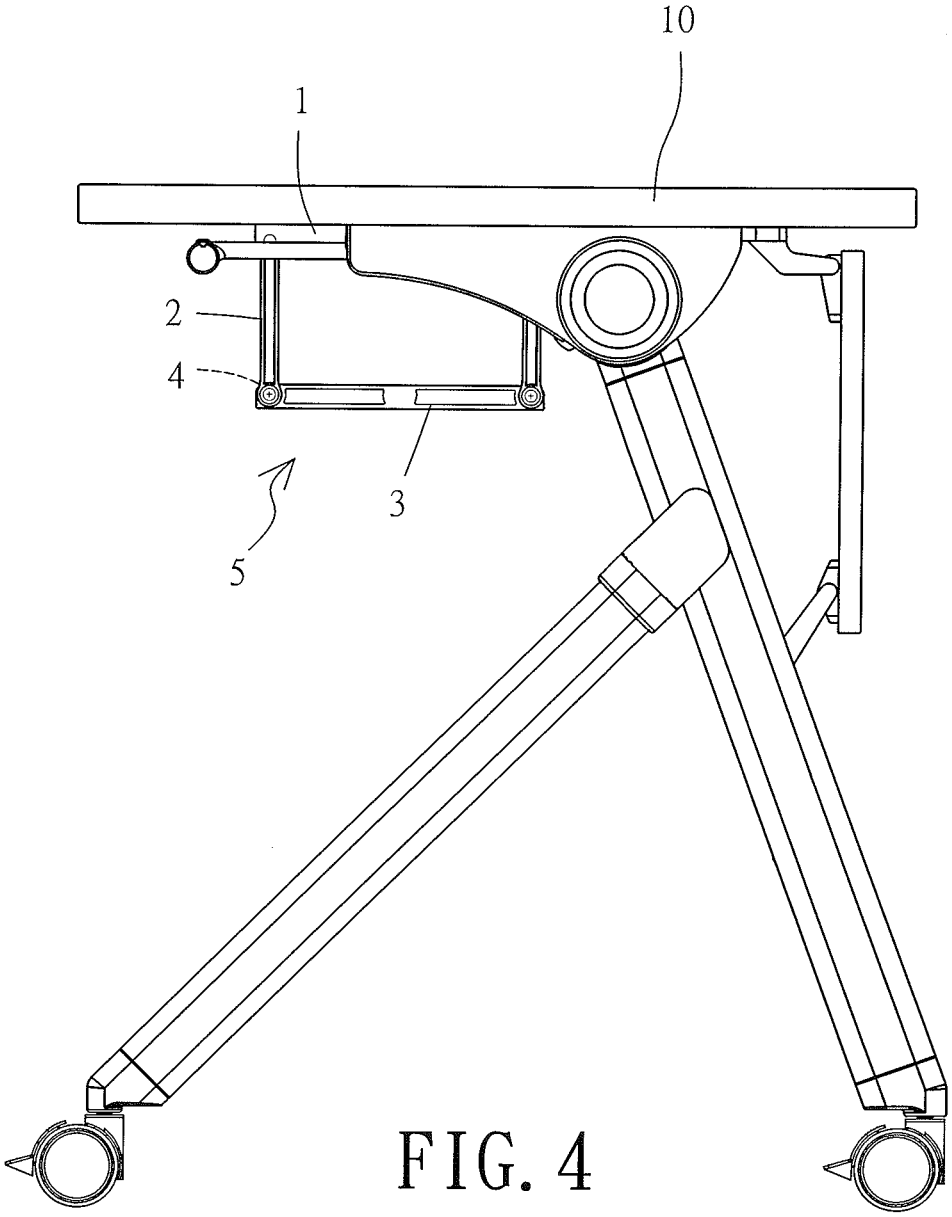
FIG. 4 is a side view of the storage rack in FIG. 3 connected to the table, with the storage rack in a horizontal state.

Referring to FIG. 1 in conjunction with FIG. 4, a storage rack 5 according to the present invention is designed for use as a storage element on the underside of a folding table 10. The storage rack 5 is connected to the underside of the table 10 and has a collapsible configuration. The storage rack 5 includes at least two fixing bases 1, plurality of suspension members 2, at least two connecting members 3, and a plurality of supporting members 4.

Figure 2:
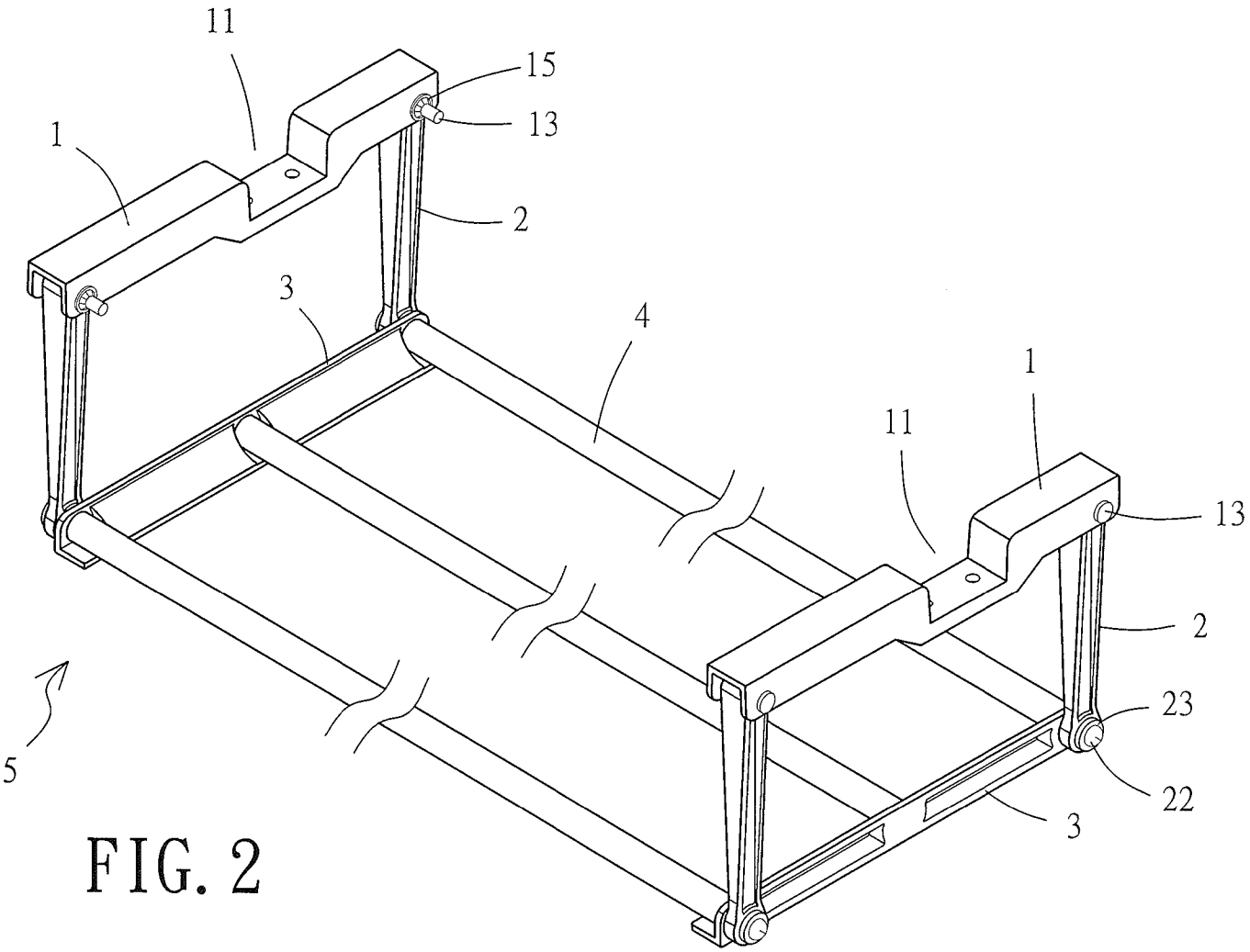
FIG. 2 is an assembled perspective view of the storage rack in FIG. 1.

As shown in FIG. 2, each of the two fixing bases 1 has a downwardly recessed portion 11 and, on either side of the downwardly recessed portion 11, receives one end of a suspension member 2. More specifically, each suspension member 2 has one end (e.g., an upper end) pivotally provided in an end portion of the corresponding one of the fixing bases 1 and the opposite end (e.g., a lower end) pressed against and pivotally connected to a predetermined lateral portion of the corresponding one of the two connecting members 3. As shown in FIG. 1 and FIG. 1-1, the corresponding sides of the two connecting members 3 are each protrudingly provided with a plurality of projections 31, which may be arranged at a predetermined spacing, and the two ends of each supporting member 4 are inserted and retained by the corresponding projections 31 of the connecting members 3 respectively, as shown in FIG. 2.

Figure 3:
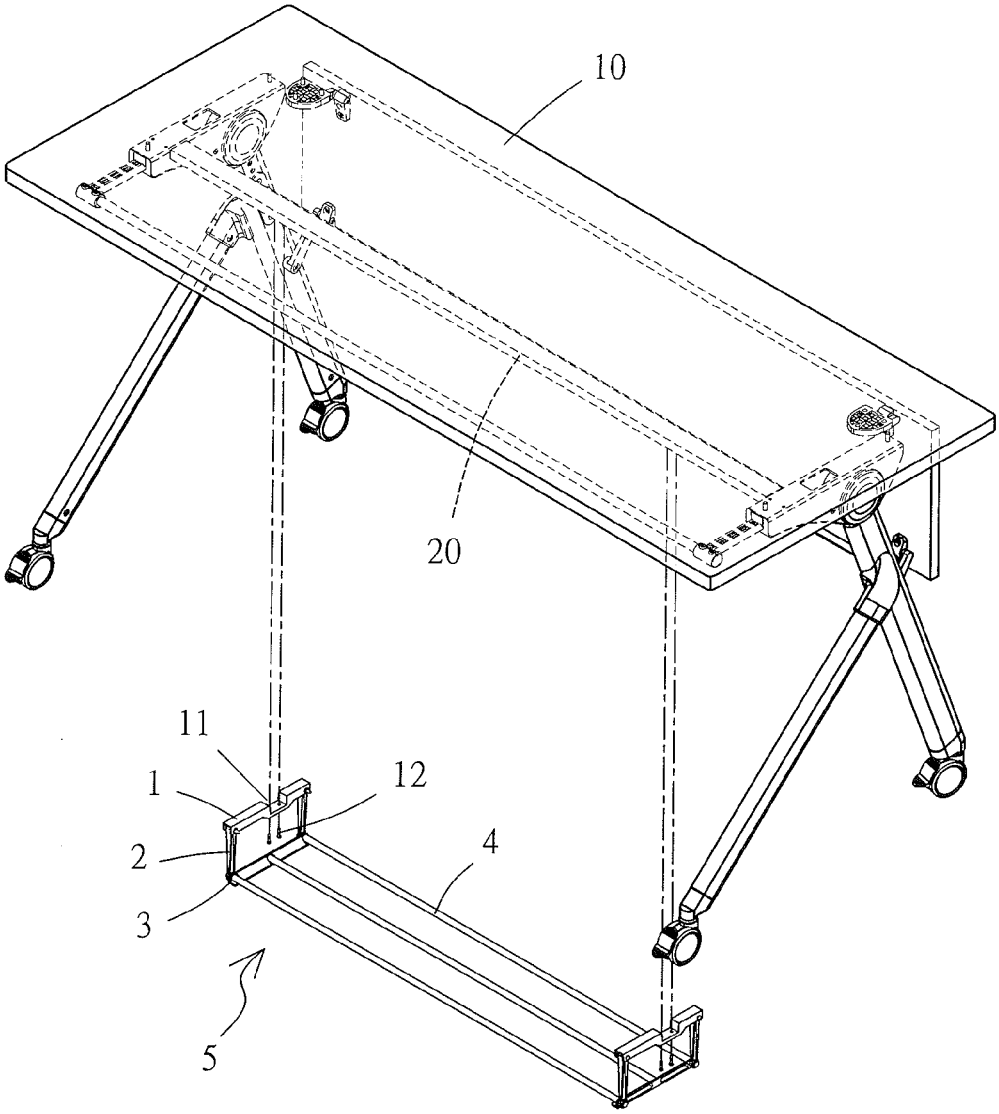
FIG. 3 shows the storage rack in FIG. 1 yet to be connected to a table.
Figure 5:
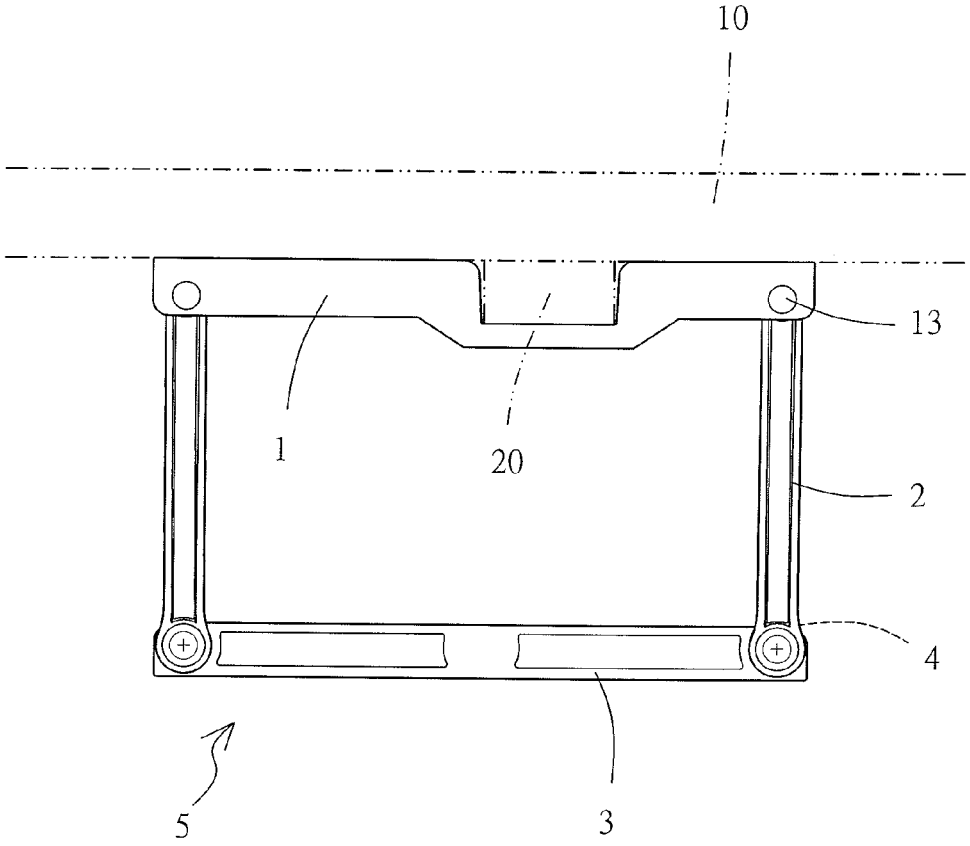
FIG. 5 is an enlarged view of the horizontal storage rack in FIG. 4.

Each fixing base 1 of the storage rack 5 has a predetermined section concavely formed with a downwardly recessed portion 11, as shown in FIG. 1. The downwardly recessed portions 11 are configured to receive a fixing member 20, which is provided on a predetermined portion of the underside of the table 10, as shown in FIG. 3 and FIG. 5, and each fixing base 1 is fixed to the fixing member 20 via threaded fasteners 12. Each suspension member 2 of the storage rack 5 is pivotally connected to the adjacent, or corresponding, fixing base 1 via a pin 13, which passes through a hole 14 in the fixing base 1 and a hole 21 in the suspension member 2 and is fastened with a position-limiting element 15 at the end protruding from the other side of the fixing base 1, as shown in FIG. 2. Thus, each suspension member 2 is pivotally connected to one end of the corresponding fixing base 1.

Each suspension member 2 of the storage rack 5 is pivotally connected to the adjacent, or corresponding, connecting member 3 via a threaded fastener 22, which passes through a sleeve 23 fitted into a hole 24 in the suspension member 2. The sleeve 23 is made of a tough material. Moreover, the end of each threaded fastener 22 that juts out of the corresponding sleeve 23 is threadedly engaged with a threaded hole 32 in the corresponding connecting member 3, such that each suspension member 2 is pivotally connected to the corresponding connecting member 3. Each projection 31 of the corresponding sides of the two connecting members 3 is peripherally provided with a plurality of raised and recessed areas, as shown in FIG. 1-1, in order to be inserted into the corresponding end of the corresponding supporting member 4 with ease and ensure that the two ends of each supporting member 4 are securely connected to the connecting members 3 respectively. In addition, the two ends of each supporting member 4 are each provided with a hole 42 at a predetermined position, and the supporting member 4 connected between the middle sections of the two connecting members 3 has a positioning pin 41 inserted through each of its holes 42 into a hole 311 in the corresponding projection 31 of the corresponding connecting member 3 to further secure this supporting member 4 to the two connecting members 3.

The storage rack 5 is fixed to a predetermined portion of the underside of the table 10 and can be used to store an object under the table 10 when the table 10 in a horizontal position as shown in FIG. 4.

Figure 6:
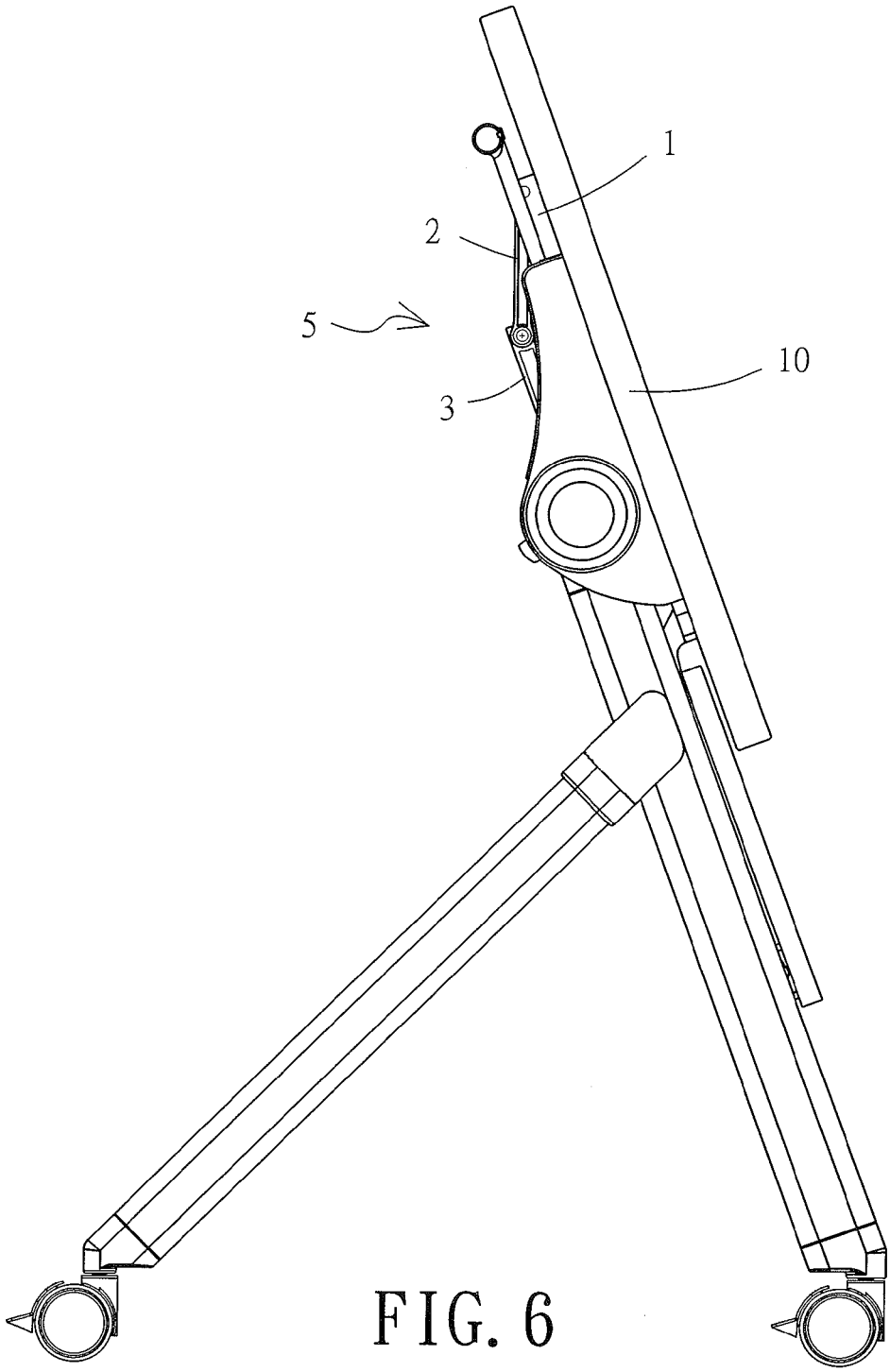
FIG. 6 is a side view of the storage rack in FIG. 3 connected to the table, with the storage rack in a folded inclined state.
Figure 7:
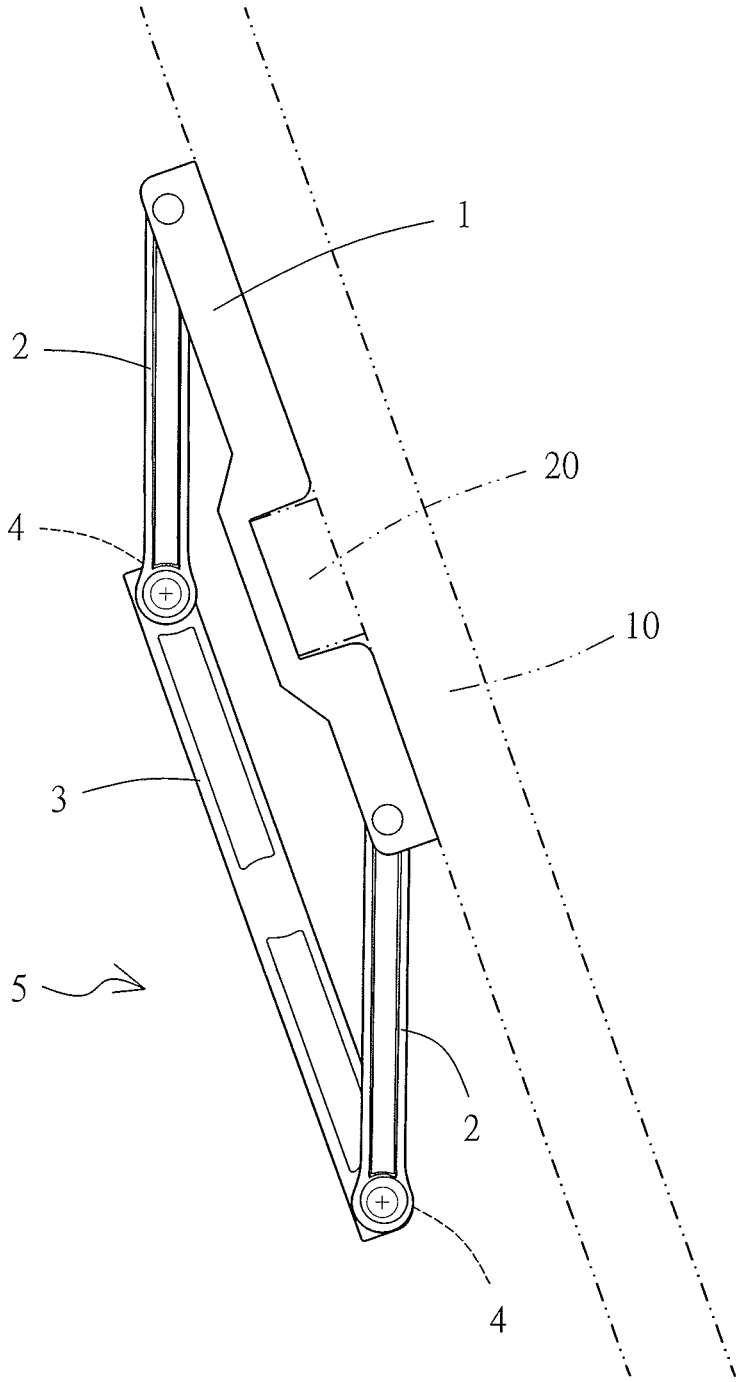
FIG. 7 is an enlarged view of the inclined storage rack in FIG. 6.

When the table 10 is not in use, it can be folded up to one side as shown in FIG. 6, and the storage rack 5 under the table 10 will be folded along with the table 10 as shown in FIG. 7. In other words, the storage rack 5 can be unfolded by expanding the table 10 and can be folded by collapsing the table 10. With the storage rack 5, the table 10 has the additional function of storing an object on the storage rack 5.

As the suspension members 2 of the storage rack 5 in FIG. 2 are configured to pivot toward one side (i.e., to pivot in the same direction as the connecting members 3 to extend in a direction closer to that of the connecting members 3), the space taken up by the storage rack 5 can be reduced to facilitate stacking when the table 10 with the storage rack 5 is to be transported.

What is claimed is:

1. A storage rack of a table, wherein the table is foldable, with the storage rack comprising at least two fixing bases, a plurality of suspension members, at least two connecting members, and a plurality of supporting members, wherein each said fixing base pivotally connects with an upper end of each said suspension member while an opposite lower end of each said suspension member is pivotally connected with a lateral portion of a corresponding one of the at least two connecting members; wherein each said supporting member has two ends retained by the at least two connecting members; wherein the at least two fixing bases are fixed to an underside of the table; wherein the plurality of suspension members, the at least two connecting members and the plurality of supporting members are foldable along with the table and are also unfoldable into a horizontal state along with the table in order for the table to store an object on the plurality of supporting portions, wherein each suspension member is pivotally connected to a corresponding fixing base via a pin, wherein said pin passes through a hole in said suspension member and a hole in a corresponding portion of the corresponding fixing base and has one end protruding from an opposite side of the corresponding fixing base and fastened with a position-limiting element, and wherein each said suspension member is pivotally connected to one end of the corresponding fixing base.

2. The storage rack of claim 1, wherein each said fixing base has a downwardly recessed portion and is configured to receive and pivotally connect with, on either side of the downwardly recessed portion, the upper end of each said suspension member while the opposite lower end of the suspension member is pressed against and pivotally connected with the predetermined lateral portion of the corresponding one of the at least two connecting members.

3. The storage rack of claim 1, wherein each said fixing base has a predetermined section concavely provided with said downwardly recessed portion, wherein the downwardly recessed portions of the at least two fixing bases are configured to receive a fixing member provided on the underside of the table, and wherein each said fixing base is fixed to the fixing member via a threaded fastener.

4. The storage rack of claim 3, wherein the at least two connecting members have corresponding sides each protrudingly provided with a plurality of projections, wherein each said supporting member has two ends each inserted unto and retained by a corresponding one of said plurality of projections of the corresponding one of the at least two connecting members.

5. A storage rack of a table, wherein the table is foldable, with the storage rack comprising at least two fixing bases, a plurality of suspension members, at least two connecting members, and a plurality of supporting members, wherein each said fixing base pivotally connects with an upper end of each said suspension member while an opposite lower end of each said suspension member is pivotally connected with a lateral portion of a corresponding one of the at least two connecting members; wherein each said supporting member has two ends retained by the at least two connecting members; wherein the at least two fixing bases are fixed to an underside of the table; wherein the plurality of suspension members, the at least two connecting members and the plurality of supporting members are foldable along with the table and are also unfoldable into a horizontal state along with the table in order for the table to store an object on the plurality of supporting portions, wherein each suspension member is pivotally connected to a corresponding connecting member via a threaded fastener, wherein said threaded fastener passes through a sleeve fitted into a hole in said suspension member and has one end threadedly engaged with a threaded hole in the corresponding connecting member, and wherein said suspension member is pivotally connected to the corresponding connecting member.

6. The storage rack of claim 5, wherein each said fixing base has a downwardly recessed portion and is configured to receive and pivotally connect with, on either side of the downwardly recessed portion, the upper end of each said suspension member while the opposite lower end of the suspension member is pressed against and pivotally connected with the predetermined lateral portion of the corresponding one of the at least two connecting members.

7. The storage rack of claim 6, wherein each said fixing base has a predetermined section concavely provided with said downwardly recessed portion, wherein the downwardly recessed portions of the at least two fixing bases are configured to receive a fixing member provided on the underside of the table, and each said fixing base is fixed to the fixing member via a threaded fastener.

8. The storage rack of claim 7, wherein the at least two connecting members have corresponding sides each protrudingly provided with a plurality of projections, wherein each said supporting member has two ends each inserted unto and retained by a corresponding one of said plurality of projections of the corresponding one of the at least two connecting members.

9. A storage rack of a table, wherein the table is foldable, with the storage rack comprising at least two fixing bases, a plurality of suspension members, at least two connecting members, and a plurality of supporting members, wherein each said fixing base pivotally connects with an upper end of each said suspension member while an opposite lower end of each said suspension member is pivotally connected with a lateral portion of a corresponding one of the at least two connecting members; wherein the at least two connecting members have corresponding sides each protrudingly provided with a plurality of projections, wherein each said supporting member has two ends each inserted unto and retained by a corresponding one of said plurality of projections of the corresponding one of the at least two connecting members; wherein the at least two fixing bases are fixed to an underside of the table; wherein the plurality of suspension members, the at least two connecting members and the plurality of supporting members are foldable along with the table and are also unfoldable into a horizontal state along with the table in order for the table to store an object on the plurality of supporting portions, wherein each projection of the corresponding sides of the at least two connecting members is peripherally provided with a plurality of raised and recessed areas to facilitate insertion into the two ends of said plurality of supporting members and to ensure secure connection between the two ends of said plurality of supporting members and the at least two connecting members.

10. The storage rack of claim 9, wherein each said fixing base has a downwardly recessed portion and is configured to receive and pivotally connect with, on either side of the downwardly recessed portion, the upper end of each said suspension member while the opposite lower end of the suspension member is pressed against and pivotally connected with the predetermined lateral portion of the corresponding one of the at least two connecting members.

11. The storage rack of claim 10, wherein each said fixing base has a predetermined section concavely provided with said downwardly recessed portion, wherein the downwardly recessed portions of the at least two fixing bases are configured to receive a fixing member provided on the underside of the table, and each said fixing base is fixed to the fixing member via a threaded fastener.

12. A storage rack of a table, wherein the table is foldable, with the storage rack comprising at least two fixing bases, a plurality of suspension members, at least two connecting members, and a plurality of supporting members, wherein each said fixing base pivotally connects with an upper end of each said suspension member while an opposite lower end of each said suspension member is pivotally connected with a lateral portion of a corresponding one of the at least two connecting members; wherein the at least two connecting members have corresponding sides each protrudingly provided with a plurality of projections, wherein each said supporting member has two ends each inserted unto and retained by a corresponding one of said plurality of projections of the corresponding one of the at least two connecting members; wherein the at least two fixing bases are fixed to an underside of the table; wherein the plurality of suspension members, the at least two connecting members and the plurality of supporting members are foldable along with the table and are also unfoldable into a horizontal state along with the table in order for the table to store an object on the plurality of supporting portions, wherein each said end of each said supporting member connected between middle sections of the at least two connecting members is penetrated by a positioning pin inserted into a corresponding projection of a corresponding connecting member to ensure secure connection between each said supporting member and the at least two connecting members.

13. The storage rack of claim 12, wherein each said fixing base has a downwardly recessed portion and is configured to receive and pivotally connect with, on either side of the downwardly recessed portion, the upper end of each said suspension member while the opposite lower end of the suspension member is pressed against and pivotally connected with the predetermined lateral portion of the corresponding one of the at least two connecting members.

14. The storage rack of claim 13, wherein each said fixing base has a predetermined section concavely provided with said downwardly recessed portion, wherein the downwardly recessed portions of the at least two fixing bases are configured to receive a fixing member provided on the underside of the table, and each said fixing base is fixed to the fixing member via a threaded fastener.

* * * * *